United States Patent [19]

Broze et al.

[11] Patent Number: 4,830,782

[45] Date of Patent: May 16, 1989

[54] HOT WATER WASH CYCLE BUILT NONAQUEOUS LIQUID NONIONIC LAUNDRY DETERGENT COMPOSITION CONTAINING AMPHOTERIC SURFACTANT AND METHOD OF USE

[75] Inventors: Guy Broze, Grace-Hollogne; Jean-Paul Delvenne, Tilff, both of Belgium

[73] Assignee: Colgate-Palmolive Company, New York, N.Y.

[21] Appl. No.: 90,994

[22] Filed: Aug. 31, 1987

[51] Int. Cl.[4] ..... C11D 1/835

[52] U.S. Cl. ..... 252/545; 252/99; 252/135; 252/174.21; 252/526; 252/527; 252/546; 252/DIG. 14

[58] Field of Search ..... 252/DIG. 14, 99, 135, 252/526, 527, 545, 546, 174.21

[56] References Cited

U.S. PATENT DOCUMENTS

| | | | |
|---|---|---|---|
| 3,850,831 | 11/1974 | Hellsten et al. | 252/95 |
| 3,925,262 | 12/1975 | Laughlin et al. | 252/545 |
| 4,005,029 | 1/1977 | Jones | 252/99 |
| 4,326,979 | 4/1982 | Bus et al. | 252/158 |
| 4,622,173 | 11/1986 | Broze et al. | 252/89.1 |

FOREIGN PATENT DOCUMENTS

| | | |
|---|---|---|
| 158464 | 10/1985 | European Pat. Off. . |
| 2163770 | 3/1986 | United Kingdom . |

*Primary Examiner*—Paul Lieberman
*Assistant Examiner*—Hoa Van Le
*Attorney, Agent, or Firm*—N. Blumenkopf; M. M. Grill; R. C. Sullivan

[57] ABSTRACT

A liquid heavy duty laundry detergent composition comprising a suspension of builder salt in nonaqueous liquid surfactant in which the high temperature cleaning performance of the composition is improved by the addition of an amphoteric surface active agent. The cleaning performance of the composition at cleaning temperatures above 60° C. is substantially improved.

21 Claims, 1 Drawing Sheet

HOT WATER WASH CYCLE BUILT NONAQUEOUS LIQUID NONIONIC LAUNDRY DETERGENT COMPOSITION CONTAINING AMPHOTERIC SURFACTANT AND METHOD OF USE

BACKGROUND OF THE INVENTION (1) Field of Invention

This invention relates to nonaqueous liquid fabric treating compositions. More particularly, this invention relates to nonaqueous liquid laundry detergent compositions which are stable against phase separation and gelation and are easily pourable and to the use of these compositions for cleaning soiled fabrics, especially at elevated wash temperatures.

More specifically, the present invention relates to cleaning compositions adapted for use in the wash cycle of a laundering operation, especially using hot water. The composition includes a nonionic surfactant and an amphoteric surfactant to increase the high temperature cleaning performance of the nonionic surfactant.

(2) Discussion of Prior Art

Liquid nonaqueous heavy duty laundry detergent compositions are well known in the art. While many of the prior art detergent formulations provide satisfactory cleaning under many different conditions they still suffer from the defects of not providing adequate cleaning performance under hot water washing conditions, i.e. at temperatures of 60° C. and higher. For instance, compositions of that type may comprise a liquid nonionic surfactant in which are dispersed particles of a builder, as shown for instance in the U.S. Pat. Nos. 4,316,812, 3,630,929 and 4,264,466 and British Patent Nos. 1,205,711, 1,270,040 and 1,600,981.

A related pending application and U.S. Patent assigned to the common assignee are Ser. No. 646,604, filed Aug. 31, 1984; and U.S. Pat. No. 4,622,173.

The application Ser. No. 646,604 discloses a dry powder composition, comprising a nonionic surfactant detergent, a quaternary ammonium salt softener and an amphoteric surfactant having improved softening and cleaning performance.

The U.S. Pat. No. 4,622,173 is directed to liquid nonaqueous nonionic laundry detergent compositions and broadly discloses that an amphoteric surfactant can be added to the composition.

Additional patents of interest are the Hellsten et al. U.S. Pat. Nos. 3,850,831 and Bus et al. 4,326,979. The patents disclose liquid nonaqueous nonionic laundry detergent compositions and broadly mention that an amphoteric surfactant can be added to the compositions.

Although it is not uncommon for present day laundry detergent compositions and for conventional home automatic washing machines, especially in the United States, to be able to effect washing/cleaning of soiled fabrics using cold or warm wash water, especially for sensitive fabrics, wash-wear fabrics, permanent-press fabrics, and the like, it is nevertheless appreciated that more effective cleaning (soil removal) requires higher washing temperatures. Furthermore, in Europe and in other countries, the home washing machines operate at hot temperatures of 60° C. or 90° C. or more, up to 100° C. the boiling temperature of the wash water. These high temperatures are very beneficial for soil removal.

Liquid detergents are often considered to be more convenient to employ than dry powdered or particulate products and, therefore, have found substantial favor with consumers. They are readily measurable, speedily dissolved in the wash water, capable of being easily applied in concentrated solutions or dispersions to soiled areas on garments to be laundered and are nondusting, and they usually occupy less storage space. Additionally, the liquid detergents may have incorpoated in their formulations materials which could not stand drying operations without deterioration, which materials are often desirably employed in the manufacture of particulate detergent products. Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

The present inventors have discovered that cleaning performance of a nonaqueous liquid detergent composition based on a mixture of a nonionic detergent is significantly increased at elevated temperatures by the addition to the composition of amphoteric surfactants. Furthermore, the increased cleaning performance at elevated temperatures is achieved without any, or at least without any significant, deterioration in washing (i.e., cleaning) performance at lower temperatures (i.e., temperatures of 20° to 40° C.).

Applicants have discovered that the mixed nonionic-/amphoteric surfactant compositions act synergistically to provide unexpected improved cleaning performance as compared to the same or greater amounts of each of the two surfactants used in the absence of the other.

Accordingly, it was totally unexpected that the cleaning performance of the nonionic surfactant could be dramatically improved at elevated temperatures, without diminishing cleaning performance at lower temperatures by adding an amphoteric surfactant to the nonionic surfactant detergent composition.

The present inventors have also been involved in studying the behavior of nonionic liquid surfactant systems with particulate matter suspended therein. Of particular interest has been nonaqueous built laundry liquid detergent compositions and the problem of settling of the suspended builder and other laundry additives as well as the problem of gelling associated with nonionic surfactants. These considerations have an impact on, for example, product stability, pourability and dispersibility.

It is known that one of the major problems with built liquid laundry detergents is their physical stability. This problem stems from the fact that the density of the solid particles dispersed in the nonionic liquid surfactant is higher than the density of the liquid surfactant.

Therefore, the dispersed particles tend to settle out. Two basic solutions exist to solve the settling out problem: increase nonionic liquid viscosity and reduce the dispersed solid particle size.

It is known that suspensions can be stabilized against settling by adding inorganic or organic thickening agents as dispersants, such as, for example, very high surface area inorganic materials, e.g. finely divided silica, clays, etc., organic thickeners, such as the cellulose ethers, acrylic and acrylamide polymers, polyelectrolytes, etc. However, such increases in suspension viscosity are naturally limited by the requirement that the liquid suspension be readily pourable and flowable, even at low temperature. Furthermore, these additives do not contribute to the cleaning performance of the formulation.

Grinding to reduce the particle size provides the following advantages:

1. Specific surface area of the dispersed particles is increased, and, therefore, particle wetting by the nonaqueous vehicle (liquid nonionic) is proportionately improved.

2. The average distance between dispersed particles is reduced with a proportionate increase in particle-to-particle invention. Each of these effects contributes to increase the rest-gel strength and the suspension yield stress while at the same time, grinding significantly reduces plastic viscosity.

The yield stress is defined as the minimum stress necessary to induce a plastic deformation (flow) of the suspension. Thus, visualizing the suspension as a loose network of dispersed particles, if the applied stress is lower than the yield stress, the suspension behaves like an elastic gel and no plastic flow will occur. Once the yield stress is overcome, the network breaks at some points and the sample begins to flow, but with a very high apparent viscosity. If the shear stress is much higher than the yield stress, the pigments are partially shear-deflocculated and the apparent viscosity decreases. Finally, if the shear stress is much higher than the yield stress value, the dispersed particles are completely shear-deflocculated and the apparent viscosity is very low, as if no particle interaction were present.

Therefore, the higher the yield stress of the suspension, the higher the apparent viscosity at low shear rate and the better is the physical stability against settling of the product.

In addition to the problem of settling or phase separation, the nonaqueous liquid laundry detergents based on liquid nonionic surfactants suffer from the drawback that the nonionics tend to gel when added to cold water. This is a particularly important problem in the ordinary use of European household automatic washing machines where the user places the laundry detergent composition in a dispensing unit (e.g. a dispensing drawer) of the machine. During the operation of the machine the detergent in the dispenser is subjected to a stream of cold water to transfer it to the main body of wash solution. Especially during the winter months when the detergent composition and water fed to the dispenser are particularly cold, the detergent viscosity increases markedly and a gel forms. As a result some of the composition is not flushed completely off the dispenser during operation of the machine, and a deposit of the composition builds up with repeated wash cycles, eventually requiring the user to flush the dispenser with hot water.

The gelling phenomenon can also be a problem whenever it is desired to carry out washing using cold water as may be recommended for certain synthetic and delicate fabrics or fabrics which can shrink in warm or hot water.

The tendency of concentrated detergent compositions to gel during storage is aggravated by storing the compositions in unheated storage areas, or by shipping the compositions during winter months in unheated transportation vehicles.

Partial solutions to the gelling problem have been proposed, for example, by diluting the liquid nonionic with certain viscosity controlling solvents and gel-inhibiting agents, such as lower alkanols, e.g. ethyl alcohol (see U.S. Pat. No. 3,953,380), alkali metal formates and adipates (see U.S. Pat. No. 4,368,147), hexylene glycol, polyethylene glycol, etc. and nonionic structure modification and optimization. As an example of nonionic surfactant modification one particularly successful result has been achieved by acidifying the hydroxyl moiety end group of the nonionic molecule. The advantages of introducing a carboxylic acid at the end of the nonionic include gel inhibition upon dilution; decreasing the nonionic pour point; and formation of an anionic surfactant when neutralized in the washing liquor. Nonionic structure optimization has centered on the chain length of the hydrophobic-lipophilic moiety and the number and make-up of alkylene oxide (e.g. ethylene oxide) units of the hydrophilic moiety. For example, it has been found that a $C_{13}$ fatty alcohol ethoxylated with 8 moles of ethylene oxide presents only a limited tendency to gel formation.

Nevertheless, improvements are desired in both the stability and gel inhibition and in the high temperature cleaning performance of nonaqueous liquid fabric treating compositions.

BRIEF DESCRIPTION OF THE INVENTION

In accordance with the present invention a highly concentrated stable nonaqueous liquid nonionic laundry detergent composition with improved high temperature cleaning performance is prepared by adding to the composition small effective amounts of an amphoteric surfactant detergent.

The compositions of the present invention contain as essential ingredients a nonionic surfactant detergent and an amphoteric surfactant.

The amphoteric surfactants used in accordance with the present invention are well known and are commercially available. The amphoteric surfactants have been used as surface active detergents.

The amphoteric detergents that can be used are those containing both the anionic and cationic group having a hydrophobic organic group, which is advantageously a higher aliphatic radical, e.g. about 10–20 carbon atoms. Among these are the N-long chain alkyl amino carboxylic acids (e.g. of the formula $RR_2NR'COOM$); N-long chain alkyl imino di-carboxylic acids (e.g. of the formula $RN(R'COOM)_2$) and the N-long chain alkyl betaines (e.g. of the formula $RR_3R_4N+—R'COO^-$) where R is a long chain alkyl group, e.g. of about 10–20 carbon atoms, R' is a divalent radical joining the amino and carboxylic portions of an amino acid (e.g. an alkylene radical of 1–4 carbon atoms), M is hydrogen or a salt forming metal, $R_2$ is a hydrogen or another monovalent substituent (e.g. methyl or other lower alkyl), and $R_3$ and $R_4$ are monovalent substituents joined to the nitrogen by carbon-to-nitrogen bonds (e.g. methyl or other lower alkyl substituents). Additional amphoteric surfactants that can be used are amido betaines, sulfobetaines, amidosulfobetaines and phosphobetaines.

The compositions can be formulated for use at wash temperatures over a broad range of say, for example, 20° to 90° C., as well as higher temperatures in order to be most useful for a broad range of fabrics including delicate natural and synthetic fibers, as well as more temperature insensitive fabrics such as cottons, etc. The formulation, however, is designed for the principal intended use at elevated washing temperatures of 60° C. or 90° C. or more, such as is generally the case in Europe, as well as when using industrial washing machines.

In order to improve the viscosity characteristics of the composition an acid terminated nonionic surfactant can be added. To further improve the viscosity characteristics of the composition and the storage properties of the composition there can be added to the composition viscosity improving and anti-gel agents such as alkylene glycols, poly alkylene glycols and alkylene glycol mono alkyl ethers and additional anti-settling stabilizing agents such as alkanol phosphoric acid esters, aluminum stearate and urea. In an embodiment of the invention the nonionic detergent composition contains an amphoteric surfactant detergent, an acid terminated nonionic surfactant, an alkylene glycol mono alkyl ether and anti-settling stabilizing agent.

Sanitizing or bleaching agents and activators therefor can be added to improve the bleaching and cleansing characteristics of the composition.

In an embodiment of the invention the builder components of the composition are ground to a particle size of less than 100 microns and to preferably less than 10 microns to further improve the stability of the suspension of the builder components in the liquid nonionic surfactant detergent.

In addition other ingredients can be added to the composition such as anti-incrustation agents, anti-foam agents, optical brighteners, enzymes, anti-redeposition agents, perfume and dyes.

The presently manufactured washing machines for home use normally operate at washing temperatures of up to 95° C. About 18.5 gallons of water are used during the wash and rinse cycles.

About 200–250 gms of powder detergent per wash is normally used.

In accordance with the present invention where the highly concentrated liquid detergent is used normally only 100 gms (78 cc) of the liquid detergent composition is required to wash a full load of dirty laundry.

Accordingly, in one aspect the present invention provides a liquid heavy duty laundry composition composed of a suspension of an anionic detergent builder salt, e.g. a phosphate builder salt, in a liquid nonionic surfactant wherein the composition includes an effective amount of an amphoteric surfactant detergent to substantially improve the high temperature cleaning performance of the composition.

According to another aspect, the invention provides a concentrated liquid heavy duty laundry detergent composition which is stable, non-settling in storage and non-gelling in storage and in use. The liquid compositions of the present invention are easily pourable, easily measured and easily put into the washing machine.

According to another aspect, the invention provides a method for dispensing a liquid nonionic laundry detergent composition into and/or with cold water without undergoing gelation. In particular, a method is provided for filling a container with a nonaqueous liquid nonionic laundry detergent composition in which the detergent is composed, at least predominantly, of a liquid nonionic surface active agent and an amphoteric detergent and for dispensing the composition from the container into an aqueous wash bath, wherein the dispensing is effected by directing a stream of unheated water onto the composition such that the composition is carried by the stream of water into the wash bath.

ADVANTAGES OVER THE PRIOR ART

The addition of the amphoteric detergent to the detergent compositions substantially improved the high temperature cleaning performance of the composition.

The improved concentrated nonaqueous liquid nonionic surfactant laundry detergent compositions of the present invention have the advantage of being stable, non-settling in storage, and non-gelling in storage. The liquid compositions are easily pourable, easily measured and easily put into the laundry washing machines, and have substantially improved high temperature cleaning performance.

OBJECTS OF THE INVENTION

Accordingly, it is an object of this invention to improve the cleaning performance of nonionic surfactant detergent compositions at elevated temperatures, e.g. above 60° C., without adversely effecting overall cleaning performance at moderate or low temperatures, e.g. below 40° C.

It is another object of the present invention to provide a stable liquid heavy duty nonaqueous nonionic surfactant detergent composition containing at least one amphoteric detergent compound and at least one anionic phosphate detergent builder salt suspended in the nonionic surfactant.

It is an other object of the invention to provide concentrated liquid fabric treating compositions which have substantially improved high temperature performance, are suspensions of insoluble inorganic particles in a nonaqueous liquid and which are storage stable, easily pourable and dispersible in cold, warm or hot water.

Another object of this invention is to formulate highly built heavy duty nonaqueous liquid nonionic surfactant laundry detergent compositions which can be poured at all temperatures and which can be repeatedly dispersed from the dispensing unit of European style automatic laundry washing machines without fouling or plugging of the dispenser even during the winter months.

A specific object of this invetion is to provide non-gelling, stable suspensions of heavy duty built nonaqueous liquid nonionic laundry detergent composition which include an effective amount of an amphoteric detergent sufficient to increase the high temperature cleaning performance of the composition.

These and other objects of the invention which will become apparent from the following description are achieved by providing a nonaqueous liquid laundry detergent composition capable of washing soiled fabrics in an aqueous wash liquid, at an elevated temperature of at least about 60° C. to about 90° C. and up to the boiling temperature of water of about 100° C., which includes a nonionic surface active agent and an amphoteric surfactant in an amount sufficient to increase the cleaning performance of the nonionic surfactant at elevated temperatures.

These objects are achieved by preparing a detergent composition by adding to the nonaqueous liquid nonionic surfactant an effective amount of an amphoteric detergent agent sufficient to increase the high temperature cleaning performance of the composition. In a preferred embodiment of the invention the composition includes inorganic or organic fabric treating additives, e.g. viscosity improving agents and one or more anti-gel agents, anti-settling stabilizing agents, anti-incrustation agents, pH control agents, bleaching agents, bleach activators, anti-foam agents, optical brighteners, enzymes, anti-redeposition agents, perfume and dyes.

The present invention with the addition of the amphoteric surfactant permits the use of the less expensive and the readily commercially available nonionic surfactant detergents and requires substantially lower amounts of total surfactants to achieve equivalent or superior cleaning performance at elevated temperatures.

DETAILED DESCRIPTION OF THE INVENTION

In accordance with the present invention the high temperature cleaning performance of a nonaqueous nonionic surfactant detergent composition is subtantially improved by the addition of an effective amount of an amphoteric detergent compound.

The addition of relatively small amounts of the amphoteric detergent to the detergent compositions is sufficient to substantially improve the high temperature cleaning performance of the detergent compositions.

The compositions of the present invention contain as an essential ingredient an amphoteric surfactant detergent compound.

Applicants have unexpectedly discovered that the high temperature cleaning performance of nonaqueous liquid nonionic surfactant detergent compositions can be substantially improved by the addition to the compositions of an amphoteric surface-active compound, for example, a carboxyethylated higher fatty alkyl (e.g. coco) amphoteric compound.

The amphoteric surfactant compound can be added to the composition in an amount of from about 2 to 30%, preferably 2 to 20%, especially preferably from about 3 to 10%, by weight of the composition.

Therefore, in a preferred embodiment of the invention which is especially useful for washing soiled fabrics in an aqueous wash water at an elevated temperature in the range of 60° to 100° C., e.g. 80° to 90° C., the detergent composition includes in addition to the nonionic surfactant an amphoteric surfactant in an amount sufficient to increase the cleaning performance of the composition at elevated temperatures.

The amount of the nonionic used is sufficient such that when added to the wash water with the amphoteric surfactant will provide improved high temperature cleaning performance. Generally, amounts of nonionic detergent range from about 10 to 70%, preferably from about 20 to about 60%, and especially preferably from about 30 to 50% by weight of the composition.

The compositions of the present invention are primarily intended for use in connection with those home and commercial laundry washing machines which operate at elevated washing temperatures, especially at water temperatures in excess of about 60° C. (140° F.), preferably in excess of 80° C. (176° F.) or 90° C. (194° F.), and especially preferably at-the-boil temperature, i.e. at about 100° C. (212° F.) or more. Naturally, however, these compositions while being particularly effective when used at these elevated washing temperatures, their cleaning performance is not diminished at lower temperatures below 60° C. down to about 40° C. or lower, e.g. about 20° C.

Amphoteric Detergents

The amphoteric detergents that can be used in accordance with the present invention are those containing both the anionic and cationic group having a hydrophobic organic group, which is advantageously a higher aliphatic radical, e.g. about 10–20 carbon atoms. Among these are the N-long chain alkyl imino carboxylic acids (e.g. of the formula $RR_2NR'COOM$); N-long chain alkyl amino di-carboxylic acids (e.g. of the formula $RN(R'COOM)_2$); the N-long chain alkyl betaines (e.g. of the formula $RR_3R_4N^+—R'COO^-$) and the N-long chain alkyl betaine dicarboxyl compounds (e.g. $RR_3N^+(R'COO^-)_2$), where R is a long chain alkyl group, e.g. of about 10–20 carbon atoms, R' is a divalent radical joining the amino and carboxylic portions of an amino acid (e.g. an alkylene radical of 1-4 carbon atoms), M is hydrogen or a salt forming metal, $R_2$ is a hydrogen or another monovalent substituent (e.g. methyl or other lower alkyl), and $R_3$ and $R_4$ are monovalent substituents joined to the nitrogen by carbon-to-nitrogen bonds [e.g. methyl or other lower alkyl substituents]. Examples of specific amphoteric detergents are N-alkyl-beta amino propionic acids; N-alkyl-beta-imino dipropionic acids and N-alkyl, N,N-dimethyl glycine; the alkyl group may be for example that derived from coco fatty alcohol, lauryl alcohol, myristyl alcohol (or a lauryl-myristyl mixture), hydrogenated tallow alcohol, cetyl, stearyl or blends of such alcohols. The substituted amino propionic and imino dipropionic acids are often supplied in the sodium or other salt forms which may likewise be used in the practice of this invention. Examples of other amphoteric detergents are the fatty imidazolines such as those made by reacting a long chain fatty acid (e.g. of 10–20 carbon atoms) with diethylene triamine and monohalo carboxylic acids having 2–6 carbon atoms, e.g. 1-coco-5-hydroxyethyl-5-carboxyethyl imidazoline; betaines containing a sulfonic group instead of a carboxylic group; betaines in which the long chain substituent is joined to the carboxylic group without an intervening nitrogen atom, e.g. inner salts of 2-trimethylamino fatty acids such as 2-trimethylaminolauric acid, and compounds of any of the previously mentioned types in which the nitrogen atom is replaced by phosphorous.

One specific class of amphoteric surfactants are the complex fatty amido surfactants of the general formula (I)

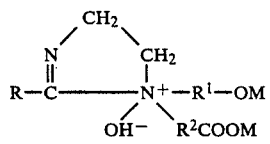

(I)

wherein R is an straight or branched, saturated or unsaturated aliphatic group having 12–18 carbon atoms (such as lauryl, tridecyl, tetradecyl, pentadecyl, palmityl, heptadecyl, stearyl, tallow, coco, soya, oleyl, linoleyl), $R^1$ and $R^2$ are each, independently, a divalent aliphatic hydrocarbon group having 2-5 carbon atoms, (e.g. methylene, ethylene, propylene, butylene, 2-methylbutylene, pentylene, etc.), and M is hydrogen or an alkali metal (e.g. sodium, potassium, cesium and lithium). Examples of compounds of formula I which are commercially available include

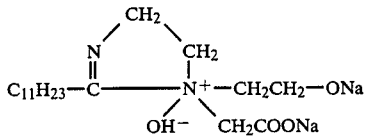

available as Miranol CM (liquid) and Miranol DM (paste) from Miranol Chemical Co.; Soromine AL and SoromineAt from GAF Corporation and the Deriphat compounds from General Mills, Inc.

The following seven groups of amphoteric surfactant compounds can also be used.

(1) Betaine detergents having the formula

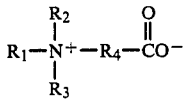

A suitable example is

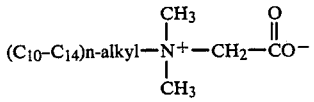

(2) Alkyl bridged betaine detergents having the formula

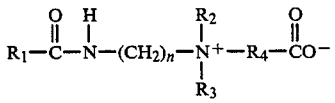

A suitable example is

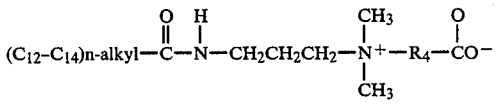

(3) Imidazoline detergents having the formula

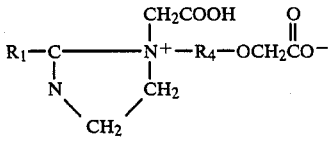

A suitable example is

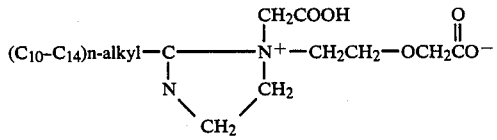

(4) Alkylimino detergents having the formula

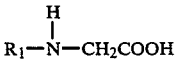

(5) Alkyliminodiacetate detergents having the formula

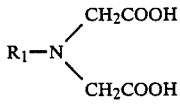

(6) Ether bridged alkyliminodipropionate detergents having the formula

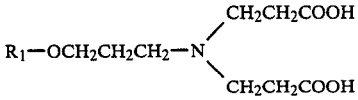

(7) Cocoimidzaoline based amphoteric detergents having the formula

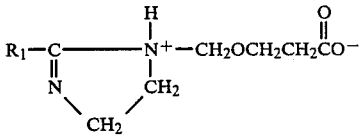

(8) Amphoteric detergents having the formula

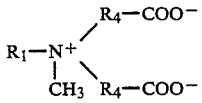

(9) Amphoteric detergents having the formula

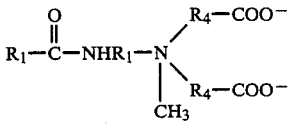

(10) Amphoteric detergents having the formula

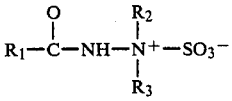

Mixtures of any of the amphotoric detergents with one another and with the amine oxide detergents listed above may also be used.

In the above formulae (1) to (10), $R_1$ is a straight or branched, saturated or unsaturated aliphatic radical containing from about 7 to about 20, preferably from about 8 to 18, especially preferably from about 10 to 14 carbon atoms, $R_2$ and $R_3$ are each lower alkyl of $C_1$ to $C_4$, preferably methyl or ethyl, especially preferably ethyl, $R_4$ is a divalent $C_1$–$C_4$ alkyl, preferably methylene or ethylene, especially preferably ethylene.

A particularly preferred group of amphoteric compounds are the carboxyethoxylated higher fatty alkylimidazoline compounds of the formula (8)

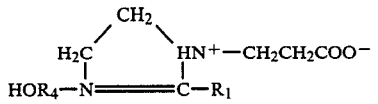

where $R_1$ is straight or branched, saturated or unsaturated aliphatic group of from 7 to 20 carbon atoms, preferably 8 to 18 carbon atoms, especially preferably 10 to 14 carbon atoms, and $R_4$ is a divalent lower alkyl group of 1 to 4 carbon atoms, preferably 1 or 2 carbon atoms. Preferred groups $R_1$ include coco, tallow, heptadecyl, oleyl, decyl, and dodecyl, especially coco (i.e. derived from coco fatty acid). The preferred group $R_4$ is ethylene ($—CH_2CH_2—$). The compound carboxyethylated cocoimidazoline is available as Rexoteric CSF, a trademarked product of Rexolin as a 100% active ingredient basis, or as a 45% active ingredient solution.

The open chain carboxyethylated higher fatty alkyl amine derivatives are another preferred class of amphoteric compound. The include the above groups (4), (5), and (6), i.e. the alkyliminopropionate and ether bridged alkyliminopropionate detergents. Caboxyethylated octyl amine which is available as Rexoteric OASF from Rexolin is an especially preferred member of this group.

There can advantageously be added to the formulation of the present invention physical stabilizers, such as, for example, an acidic organic phosphorus compound having an acidic-POH group, such as a partial ester of phosphorus acid and an alkanol, an aluminum salt of a fatty acid, or a urea compound.

Nonionic Surfactant Detergent

The nonionic synthetic organic detergents employed in the practice of the invention may be any of a wide variety of known compounds.

As is well known, the nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of mols of lower alkyleneoxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to lower alkoxy groups per ml. Preferably, the lower alkoxy is ethoxy but in some instances, it may be desirably mixed with propoxy, the latter, if present, often being a minor (less than 50%) proportion.

Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols.

Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present composition as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company.

Other useful nonionics are represented by the commercially well known class of nonionics sold under the trademark Plurafac. The Plurafacs are the reaction product of a higher linear alcohol and a mixture of ethylene and propylene oxides, containing a mixed chain of ethylene oxide and propylene oxide, terminated by a hydroxyl group. Examples include products which are (A), $C_{13}$–$C_{15}$ fatty alcohol condensed with 6 moles ethylene oxide and 3 moles propylene oxide, (B) $C_{13}$–$C_{15}$ fatty alcohol condensed with 7 moles propylene oxide and 4 moles ethylene oxide, (C) $C_{13}$–$C_{15}$ fatty alcohol condensed with 5 moles propylene oxide and 10 moles ethylene oxide, and (D) a product which is a 1:1 mixture of products (B) and (C). Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 20% but, as is in the cases of the mentioned Terigtols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of the viscosity and gel controlling compounds of the invention can also improve the properties of the detergents based on such nonionics. In some cases, as when a higher molecular weight polylower alkoxylated higher alkanol is employed, often for its detergency, the proportion thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures.

Another useful group of nonionic surfactants are the "Surfactant T" series of nonionics available from British Petroleum. The Surfactant T nonionics are obtained by the ethoxylation of secondary $C_{13}$ fatty alcohols having a narrow ethylene oxide distribution. The Surfactant T5 has an average of 5 moles of ethylene oxide; Surfactant T7 an average of 7 moles of ethylene oxide; Surfactant T9 an average of 9 moles of ethylene oxide and Surfactant T12 an average of 12 moles of ethylene oxide per mole of secondary $C_{13}$ fatty alcohol.

In the compositions of this invention, preferred nonionic surfactants include the $C_{12}$–$C_{15}$ secondary fatty alcohols with relatively narrow contents of ethylene oxide in the range of from about 7 to 9 moles, and the C9 to C11 fatty alcohols ethoxylated with about 5–6 moles ethylene oxide.

Mixtures of two or more of the liquid nonionic surfactants can be used and in some cases advantages can be obtained by the use of such mixtures.

Acid Terminated Nonionic Surfactant

The viscosity and gel properties of the liquid detergent compositions can be improved by including in the composition an effective amount an acid terminated liquid nonionic surfactant. The acid terminated nonionic surfactants consist of a nonionic surfactant which has been modified to convert a free hydroxyl group thereof to a moiety having a free carboxyl group, such as an ester or a partial ester of a nonionic surfactant and a polycarboxylic acid or anhydride.

As disclosed in the commonly assigned copending application Ser. No. 597,948 filed Apr. 9, 1984, the disclosure of which is incorporated herein by reference, the free carboxyl group modified nonionic surfactants, which may be broadly characterized as polyether carboxylic acids, function to lower the temperature at which the liquid nonionic forms a gel with water.

The addition of the acid terminated nonionic surfactants to the liquid nonionic surfactant aids in the dispensibility of the composition, i.e. pourability, and lowers the temperature at which the liquid nonionic surfactants form a gel in water without a decrease in their stability against settling. The acid terminated nonionic surfactant reacts in the washing machine water with the alkalinity of the dispersed builder salt phase of the detergent composition and acts as an effective anionic surfactant.

Specific examples include the half-esters of product (A) with succinic anhydride, the ester or half ester of Dobanol 25-7 with succinic anhydride, and the ester or half ester of Dobanol 91-5 with succinic anhydride. Instead of succinic anhydride, other polycarboxylic acids or anhydrides can be used, e.g. maleic acid, maleic acid anhydride, glutaric acid, malonic acid, phthalic acid, phthalic anhydride, citric acid and the like.

The acid terminal nonionic surfactants can be prepared as follows:

Acid Terminated product (A). 400 g of product (A) nonionic surfactant which is a $C_{13}$ to $C_{15}$ alkanol which has been alkoxylated to introduce 6 ethylene oxide and 3 propylene oxide units per alkanol unit is mixed with 32 g of succinic anhydride and heated for 7 hours at 100° C. The mixture is cooled and filtered to remove unreacted succinic material. Infrared analysis indicated that about one half of the nonionic surfactant has been converted to the acidic half-ester thereof.

Acid Terminated Dobanol 25-7. 522 g of Dobanol 25-7 nonionic surfactant which is the product of ethoxylation of a $C_{12}$ to $C_{15}$ alkanol and has about 7 ethylene oxide units per molecule of alkanol is mixed with 100 g of succinic anhydride and 0.1 g of pyridine (which acts as an esterification catalyst) and heated at 260° C. for 2 hours, cooled and filtered to remove unreacted succinic material. Infrared analysis indicates that substantially all the free hydroxyls of the surfactant have reacted.

Acid Terminate Dobanol 91-5. 1000 of Dobanol 91-5 nonionic surfactant which is the product of ethoxylation of a $C_9$ to $C_{11}$ alkanol and has about 5 ethylene oxide units per molecule of alkanol is mixed with 265 g of succinic anhydride and 0.1 g of pyridine catalyst and heated at 260° C. for 2 hours, cooled and filtered to remove unreacted succinic material. Infrared analysis indicates that substantially all the free hydroxyls of the surfactant have reacted.

Other esterification catalysts, such as an alkali metal alkoxide (e.g. sodium methoxide) may be used in place of, or in admixture with, the pyridine.

The acidic polyether compound, i.e. the acid terminated nonionic surfactant is preferably added dissolved in the nonionic surfactant.

BUILDER SALTS

The liquid nonaqueous nonionic surfactant used in the compositions of the present invention has dispersed and suspended therein fine particles of inorganic and/or inorganic detergent builder salts.

The invention detergent compositions include water soluble and/or water insoluble detergent builder salts. Water soluble inorganic alkaline builder salts which can be used alone with the detergent compound or in admixture with other builders are alkali metal carbonates, bicarbonates, borates, phosphates, polyphosphates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. Sodium tripolyphosphate (TPP) is especially preferred.

Since the compositions of this invention are generally highly concentrated, and, therefore, may be used at relatively low dosages, it is desirable to supplement any phosphate builder (such as sodium tripolyphosphate) with an auxiliary builder such as a poly lower carboxylic acid or a polymeric carboxylic acid having high calcium binding capacity to inhibit incrustation which could otherwise be caused by formation of an insoluble calcium phosphate.

A suitable lower poly carboxylic acid comprises alkali metal salts of lower polycarboxylic acids, preferably the sodium and potassium salts. Suitable lower polycarboxylic acids have two to four carboxylic acid groups. The preferred sodium and potassium lower polycarboxylic acid salts are the citric and tartaric acid salts.

The sodium citric acid salts are the most preferred, especially the trisodium citrate. The monosodium and disodium citrates can also be used. The monosodium and disodium tartaric acid salts can also be used. The alkali metal lower polycarboxylic acid salts are particularly good builder salts; because of their high calcium and magnesium binding capacity they inhibit incrustation which could otherwise be caused by formation of insoluble calcium and magnesium salts.

In jurisdictions in which the use of phosphate detergents are regulated, the alkali metal citric and tartaric acid salts can be used to replace part or all of the phosphate detergent builder in the compositions of the present invention.

Other organic builders are polymers and copolymers of polyacrylic acid and polymaleic anhydride and the alkali metal salts thereof. More specifically such builder salts can consist of a copolymer which is the reaction product of about equal moles of methacrylic acid and maleic anhydride which has been completely neutralized to form the sodium salt thereof. The builder is commercially available under the tradename of Sokalan CP5. This builder serves when used even in small amounts to inhibit incrustation.

Examples of organic alkaline sequestrant builder salts which can be used with the detergent builder salts or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA), and triethanolammonium N-(2-hydroxyethyl)nitrilodiacetates. Mixed salts of these aminopolycarboxylates are also suitable.

Other suitable builders of the organic type include carboxymethylsuccinates, tartronates and glycollates. Of special value are the polyacetal carboxylates. The polyacetal carboxylates and their use in detergent compositions are described in application Ser. No. 767,570 filed Aug. 20, 1985 assigned to applicants' assignee and in a U.S. Pat. Nos. 4,144,226, 4,315,092 and 4,146,495.

The alkali metal silicates are useful builder salts which also function to adjust or control the pH and to make the composition anticorrosive to washing machine parts. Sodium silicate of $Na_2O/SiO_2$ ratios of from 1.6/1 to $\frac{1}{3}$.2, especially about $\frac{1}{2}$ to $\frac{1}{2}$b .8 are preferred. Potassium silicates of the same ratios can also be used.

Other typical suitable builders include, for example, those disclosed in U.S. Pat. Nos. 4,316,812, 4,264,466 and 3,630,929. The inorganic builder salts can be used with the nonionic surfactant detergent compound or in admixture with other inorganic builder salts or with organic builder salts.

The water insoluble crystalline and amorphous aluminosilicate zeolites can be used. The zeolites generally have the formula $$(M_2O)_x.(Al_2O_3)_y.(SiO_2)_z.wH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4a particularly preferred. The preferred aluminosilicates have calcium ion exchange capacities of about 200 milliequivalents per gram or greater, e.g. 400meq 1 g.

Various crystalline zeolites (i.e. alumino-silicates) that can be used are described in British Patent No. 1,504,168, U.S. Pat. No. 4,409,136 and Canadian Pat. Nos. 1,072,835 and 1,087,477, all of which are hereby incorporated by reference for such descriptions. An example of amorphous zeolites useful herein can be found in Belgium Pat. No. 835,351 and this patent too is incorporated herein by reference.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc., may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Guan.

VISCOSITY CONTROL AND ANTI-GEL AGENTS

The inclusion in the detergent composition of an effective amount of viscosity control and gel-inhibiting agents for the nonionic surfactant improves the storage properties, of the composition. The viscosity control and gel-inhibiting agents act to lower the temperature at which the nonionic surfactant will form a gel when added to water. Such viscosity control and gel-inhibiting agents can be for example, lower alkanol, e.g. ethyl alcohol (see U.S. Pat. No. 3,953,380), hexylene glycol, polyethylene glycol, for example, polyethylene glycol having a molecular weight of about 400 (PEG 400) and low molecular weight alkylene oxide lower mono-alkyl ether amphiphilic compounds.

Preferred viscosity control and gel-inhibiting compounds are the amphiphilic compounds. The amphiphilic compounds can be considered to be analogous in chemical structure to the ethoxylated and/or propoxylated fatty alcohol liquid nonionic surfactant but have relatively short hydrocarbon chain lengths ($C_2$ to $C_8$) and a low content of ethylene oxide (about 2 to 6 ethylene oxide groups per molecule).

Suitable amphiphilic compounds are represented by the following general formula $$R^1O(\overset{R^2}{\overset{|}{C}}H_2CH_2O)_nH$$

where $R^1$ is a $C_2$—$C_8$ alkyl group, and n is a number of from about 1 to 6, on average, and $R^2$ is hydrogen or methyl.

Specifically the compounds are lower ($C_2$ to $C_3$) alkylene glycol mono lower ($C_2$ to $C_5$) alkyl ethers.

More specifically the compounds are mono di- or tri lower ($C_2$ to $C_3$) alkylene glycol mono lower ($C_1$ to $C_5$) alkyl ethers.

Specific examples of suitable amphiphilic compounds include ethylene glycol monoethyl ether ($C_2H_5$—O—$CH_2CH_2OH$), diethylene glycol monobutyl ether ($C_4H_9$—O—$(CH_2CH_2O)_2H$), tetraethylene glycol monobutyl ether ($C_4H_7$—O—$(CH_2CH_2O)_4H$) and dipropylene glycol monomethyl ether ($CH_3$—O—$(CH_2CH_2CH_2O)_2H$. Diethylene glycol monobutyl ether is especially preferred.

The inclusion in the composition of the low molecular weight lower alkylene glycol mono alkyl ether decreases the viscosity of the composition, such that it is more easily pourable, improves the stability against settling and improves the dispersibility of the composition on the addition to warm water or cold water.

The compositions of the present invention have improved viscosity and stability characteristics and remain stable and pourable at temperatures as low as about 5° C. and lower.

In an embodiment of this invention a stabilizing agent which is an alkanol ester of phosporic acid, an aluminum salt of a higher fatty acid or an urea compound can be added to the formulation.

Improvements in stability of the composition may be achieved by incorporation of a small effective amount of an acidic organic phosphorus compound having an acidic—POH group, such as a partial ester of phosphorous acid and an alkanol.

As disclosed in the commonly assigned copending application Ser. No. 597,948 filed Apr. 9, 1984 the disclosure of which is incorporated herein by reference, the acidic organic phosphorous compound having an acidic—POH group can increase the stability of the suspension of builders in the nonaqueous liquid nonionic surfactant.

The acidic organic phosphorus compound may be, for instance, a partial ester of phosphoric acid and an alcohol such as an alkanol which has a lipophilic character, having, for instance, more than 5 carbon atoms, e.g. 8 to 20 carbon atoms.

A specific example is a partial ester of phosphoric acid and a $C_{16}$ to $C_{18}$ alkanol (Empiphos 5632 from Marchon); it is made up of about 35% monoester and 65% diester.

The inclusion of quite small amounts of the acidic organic phosphorus compound makes the suspension stable against settling on standing but remains pourable, while, for the low concentration of stabilizer, e.g. below about 1%, its plastic viscosity will generally decrease.

Improvements in the stability and anti-settling properties of the composition may also be achieved by the addition of a small effective amount of an aluminum salt of a higher fatty acid to the composition.

The aluminum salt stabilizing agents are the subject matter of the commonly assigned copending application Ser. No. 725,455 filed Apr. 22, 1985, the disclosure of which is incorporated herein by reference.

The preferred higher aliphatic fatty acids will have from about 8 to about 22 carbon atoms, more preferably from about 10 to 20 carbon atoms, and especially preferably from about 12 to 18 carbon atoms. The aliphatic radical may be saturated or unsaturated and may be straight or branched. As in the case of the nonionic surfactants, mixtures of fatty acids may also be used, such as those derived from natural sources, such as tallow fatty acid, coco fatty acid, etc.

Examples of the fatty acids from which the aluminum salt stabilizers can be formed include, decanoic acid, dodecanoic acid, palmitic acid, myristic acid, stearic acid, oleic acid, eicosanoic acid, tallow fatty acid, coco fatty acid, mixtures of these acids, etc. The aluminum salts of these acids are generally commercially available, and are preferably used in the triacid form, e.g. aluminum stearate as aluminum tristearate $Al(C_{17}H_{35}COO)_3$. The monoacid salts, e.g. aluminum monostearate, $Al(OH)_2(C_{17}H_{35}COO)$ and diacid salts, e.g. aluminum distearate, $Al(OH)(C_{17}H_{35}COO)_2$, and mixtures of two or three of the mono-, di- and triacid aluminum salts can also be used. It is most preferred, however, that the triacid aluminum salt comprises at lesat 30%, preferably at least 50%, especially preferably at least 80% of the total amount of aluminum fatty acid salt The aluminum salts, as mentioned above, are commercially available and can be easily produced by, for example, saponifying a fatty acid, e.g. animal fat, stearic acid, etc., followed by treatment of the resulting soap with alum, alumina, etc.

UREA COMPOUND STABILIZERS

The urea compound anti-settling stabilizing agents that can be used in the present invention are disclosed in the commonly assigned copending application Ser. No. 767,569 filed Aug. 20, 1985, the disclosure of which is incorporated herein by reference.

The urea compound even when added to the composition in small amounts improves the dispersibility of the suspension of builder salt by acting to inhibit gel formation of the suspension of builder when contacted with water.

The urea improves dispersibility by inhibiting gel formation of the suspension of detergent builder salt particles when water is added to the composition, for example, in the dispensing drawer of a washing machine and/or when the composition is added to the wash water.

In addition to the action as a physical stabilizing agent, the urea compounds have the advantages over other physical stabilizing agents that they are compatible with the nonionic surfactant component and that they substantially improve the dispensibility of the detergent composition in cold water.

Only very small amounts of urea compound are required to obtain the significant improvements in physical stability of the detergent composition, and the dispersibility of the composition in cold water. For example, based on the total weight of the nonionic liquid surfactant composition, suitable amounts of urea are in the range of from about 0% to about 3%, preferably from about 0.2% to about 2.0% and more preferably about 0.5 to 1.5%.

BLEACHING AGENTS

The bleaching agents are classified broadly, for convenience, as chlorine bleaches and oxygen bleaches. Chlorine bleaches are typified by sodium hypochlorite (NaOCl), potassium dichloroisocyanurate (59% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U.S. Pat. No. 4,264,466 or in column 1 of U.S. Pat. No. 4,430,244, the relevant disclosures of which are incorporated herein by reference. Polyacylated compounds are preferred activators; among these, compounds such as tetraacetyl ethylene diamine ("TAED") and pentaacetyl glucose are particularly preferred.

Other useful activators include, for example, acetylsalicylic acid derivatives, ethylidene benzoate acetate and its salts, ethylidene carboxylate acetate and its salts, alkyl and alkenyl succinic anhydride, tetraacetylglycouril ("TAGU"), and the derivatives of these. Other useful classes of activators are disclosed, for example, in U.S. Pat. Nos. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions.

Suitable sequestering agents for this purpose include the sodium salts of nitrilotriacetic acid (NTA), ethylene diamine tetraacetic acid (EDTA), diethylene triamine pentaacetic acid (DETPA), diethylene triamine pentamethylene phosphonic acid (DTPMP) sold under the tradename Dequest 2066; and ethylene diamine tetramethylene phosphonic acid (EDITEMPA). The sequestering agents can be used alone or in admixture.

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred nonaqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

It is noted, however, that in compositions containing an activated bleach, that the free nitrogen based amphoteric surfactants can be readily oxidated and are preferably not used in such compositions.

In addition to the detergent builders, various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, and hydroxy-propyl methyl cellulose. A preferred anti-redeposition agent is sodium carboxymethyl cellulose having a 2:1 ratio of CM/MC which is sold under the tradename Relatin DM 4050.

There may also be included in the composition small amounts of Alcosperse D107 which is sodium polyacrylate and which functions as an anti-scaling agent. The Alcosperse D107 can be included in amounts such as 0.5 to 8%, preferably 2 to 6% and more preferably 3 to 5% by weight of the composition.

Optical brighteners for cotton, polyamide and polyester fabrics can be used. Suitable optical brighteners include stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dianilinodimorphalino stilbene polysulfonate.

Enzymes, preferably proteolytic enzymes, such as subtilisin, bromelin, papain, trypsin and pepsin, as well as amylase type anzymes, lipase type enzymes, and mixtures thereof can be added. Preferred enzymes include protease slurry, esperase slurry and amylase. A preferred enzyme is Esperse SL8. Anti-foam agents, e.g. silicon compounds, such as Silicane L 7604, which is a polysiloxane and can be added in small effective amounts.

Bactericides, e.g. tetrachlorosalicylanilide and hexachlorophene, fungicides, dyes, pigments (water dispersible), preservatives, ultraviolet absorbers, anti-yellowing agents, such as sodium carboxymethyl cellulose, pH modifiers and pH buffers, color safe bleaches, perfume, and dyes and bluing agents such as ultramarine blue can be used.

The composition may also contain small amounts of Bentone 27 which is an organic derivative of hydrous magnesium aluminum silicate. The Bentone 27 can be used in amounts such as 0.2 to 3%, preferably 0.5 to 2%, and more preferably about 1% by weight.

The composition may also contain an inorganic insoluble thickening agent or dispersant of very high surface area such as finely divided silica of extremely fine particle size (e.g. of 5–100 millimicrons diameters such as sold under the name Aerosil) or the other highly voluminous inorganic carrier materials disclosed in U.S. Pat. No. 3,630,929, in proportions of 0.1–10%, e.g. 1 to 5%. It is preferable, however, that compositions which form peroxyacids in the wash bath (e.g. compositions containing peroxygen compound and activator therefor) be substantially free of such compounds and of other silicates; it has been found, for instance, that silica and silicates promote the undesired decomposition of the peroxyacid.

In an embodiment of the invention the stability of the builder salts in the composition during storage and the dispersibility of the composition in water is improved by grinding and reducing the particle size of the solid builders to less than 100 microns, preferably less than 40 microns and more preferably to less than 10 microns. The solid builders, e.g. sodium tripolyphosphate (TPP), are generally supplied in particle sizes of about 100, 200 or 400 microns. The nonionic liquid surfactant phase can be mixed with the solid builders prior to or after carrying out the grinding operation.

In a preferred embodiment of the invention, the mixture of liquid nonionic surfactant and solid ingredients is subjected to an attrition type of mill in which the particle sizes of the solid ingredients are reduced to less than about 10 microns, e.g. to an average particle size of 2 to 10 microns or even lower (e.g. 1 micron). Preferably less than about 10%, especially less than about 5% of all the suspended particles have particle sizes greater than 10 microns. Compositions whose dispersed particles are of such small size have improved stability against separation or settling on storage. Addition of the acid terminated nonionic surfactant compound can decrease the yield stress of such dispersions and aid in the dispersibility of the dispersions without a corresponding decrease in the dispersions stability against settling.

In the grinding operation, it is preferred that the proportion of solid ingredients be high enough (e.g. at least about 40% such as about 50%) that the solid particles are in contact with each other and are not substantially shielded from one another by the nonionic surfactant liquid. After the grinding step any remaining liquid nonionic surfactant can be added to the ground formulation. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g. to about 40 microns) prior to the step of grinding to an average particle diameter below about 10 microns in the continuous ball mill.

The nonionic/amphoteric surfactant mixture has unexpectedly improved cleaning performance as compared to an equal weight of the same nonionic alone. For example, using carboxyethylated higher fatty alkyl imidazoline as the amphoteric about 20 to 60% of the nonionic can be replaced with only about 10 to 30% of the amphoteric to achieve the same or superior cleaning performance.

Since the amphoteric can act synergistically with the nonionic with respect to cleaning performance the total amount of nonionic and amphoteric in the detergent formula can be greatly reduced.

The water temperature can be from 20° C. to 100° C. and is preferably from 60° C. to 90° C. or 100° C. in those cases where the textile or laundry is capable of withstanding high temperatures without deterioration or fading of dyes. When low temperature laundering is desired, the temperature may be held at 20° to 40° C., under which conditions good cleaning are the result, although the product may not be as clean as when washed at the higher temperatures.

The compositions of the present invention provide significantly improved cleaning performance, at washing temperatures of at least 60° C., as compared, for example, to identical formulations, except that the amphoteric is not used.

It is a particular advantage of the detergent-softener compositions of this invention that since they can provide better cleaning performance with lower total amounts of surfactants more highly concentrated formulations can be prepared and packaged for use by the consumer.

In the preferred heavy duty liquid laundry detergent compositions of the invention, typical proportions (percent based on the total weight of composition, unless otherwise specified) of the ingredients are as follows:

Liquid nonionic surfactant detergent in the range of about 10 to 70, such as 20 to 60 percent, e.g. about 30 to 50 percent.

Acid terminated nonionic surfactant in an amount in the range of about 0 to 20, such as 1 to 15 percent, e.g. about 1 to 5.

Detergent builder, such as sodium tripolyphosphate (TPP), in the range of about 10 to 60, such as 15 to 50 percent, e.g. about 15 to 35.

Alkali metal silicate in the range of about 0 to 30, such as 5 to 20 percent, e.g. about 5 to 10.

Copolymer of methacrylic acid and maleic anhydride alkali metal salt anti-incrustation agent in the range of about 0 to 10, such as 1 to 5 percent, e.g. about 1 to 4.

Alkylene glycol viscosity control and gel-inhibiting agent in an amount in the range of about 0 to 30, such as 5 to 20 percent, e.g. about 8 to 15. The preferred viscosity control and gel-inhibiting agents are the alkylene glycol mono-alkylethers.

The amphoteric surfactant in the range of about 2 to 30%, preferably 2 to 20% and especially from about 3 to 10%. Suitable weight ratios of nonionic detergent:amphoteric detergent within the above-mentioned amounts are in the range of from about 1:1 to 10:1, preferably 1:1 to 8:1, and especially 2:1 to 6:1. It is an essential feature of the invention that at least one of the amphoteric detergents salts be included in the composition.

Phosphoric acid alkanol ester stabilizing agent in the range of 0 to 2.0 or 0.1 to 2.0, such as 0.50 to 1.0 percent.

Aluminum salt of fatty acid stabilizing agent in the range of about 0 to 3.0, such as 0.1 to 2.0 percent, e.g. about 0.5 to 1.0 percent.

Urea stabilizing agent in the range of about 0 to 3.0, or 0.2 to 2.0, such as 0.5 to 1.0 percent.

Bleaching agent in the range of about 0 to 30, such as 2 to 20, e.g. about 5 to 15 percent.

Bleach activator in the range of about 0 to 15, such as 1 to 10, e.g. about 1 to 8 percent.

Sequestering agent for bleach in the range of about 0 to 3.0, preferably 0.5 to 2.0 percent, e.g. about 0.50 to 1.25 percent.

Anti-redeposition agent in the range of about 0 to 5.0, preferably 0.5 to 4.0 percent, e.g. 1.0 to 3.0 percent.

Optical brightener in the range of about 0 to 2.0, preferably 0.25 to 1.0 percent, e.g. 0.25 to 0.75 percent.

Enzymes in the range of about 0 to 3.0, preferrably 0.5 to 2.0 percent, e.g. 0.50 to 1.25 percent.

Perfume in the range of about 0 to 3.0, preferably 0.25 to 1.25 percent, e.g. 0.50 to 1.0 percent.

Dye in the range of about 0 to 0.10, preferably 0.0025 to 0.050, e.g. 0.0025 to 0.0100 percent.

Pigment in the range of about 0 to 4.0 percent, preferably 0.1 to 2 percent, e.g. 0.1 to 1 percent.

Various of the previously mentioned additives can optionally be added to achieve the desired function of the added materials.

Mixtures of the acid terminated nonionic surfactant and viscosity control and gel-inhibiting agents, e.g. the alkylene glycol alkyl ether anti-gel agents, can be used and in some cases advantages can be obtained by the use of such mixtures alone, or with the addition to the mixture of one or more of the anti-settling stabilizing agent.

In the selection of the additives, they will be chosen to be compatible with the main constituents of the detergent composition. In this application, as mentioned above, all proportions and percentages are by weight of the entire formulation or composition unless otherwise indicated.

The concentrated nonaqueous nonionic liquid detergent composition of the present invention containing an amphoteric detergent are stable in storage, have improved high temperature cleaning performance and dispense readily in the water in the washing machine.

The liquid nonionic detergent compositions of the present invention are preferably nonaqueous, e.g. they are substantially nonaqueous. The term "nonaqueous" as used herein means that no water is intentionally added to the system. Minor amounts of water, however, can be present, due to the addition of specific ingredients. Though minor amounts of water can be tolerated, it is preferred that the compositions contain less than 3%, preferably less than 2% and more preferably less than 1% water.

The presently used home washing machines normally use 200–250 grams of powder detergent to wash a full load of laundry. In accordance with the present invention only 100 cc or 78 grams of the concentrated liquid nonionic detergent composition is needed.

In an embodiment of the invention the detergent composition of a typical formulation is formulated using the below named ingredients:

| | Weight % |
|---|---|
| Nonionic surfactant detergent or mixture thereof. | 30–50 |
| Acid terminated surfactant. | 0–20 |
| Phosphate detergent builder salt. | 15–35 |
| Copolymer of polyacrylate and polymaleic anhydride alkali metal salt anti-encrustation agent (Sokalan CP-5). | 0–10 |
| Alkylene glycol viscosity control and gel-inhibiting agent. | 0–25 |
| Amphoteric detergent. | 2–20 |
| Anti-settling stabilizing agent. | 0–2.0 |
| Anti-redeposition agent. | 0–5.0 |
| Alkali metal perborate bleaching agent. | 3–15 |
| Bleach activator (TAED). | 1.0–6.0 |
| Sequestering agent. | 0–3.0 |
| Optical brightener (Stilbene Brightener N4). | 0–2.0 |
| Enzymes (Protease-Esperase SL8). | 0–3.0 |
| Perfume. | 0–3.0 |
| Pigment. | 0–4.0 |

The present invention is further illustrated by the following examples.

EXAMPLE 1

A concentrated nonaqueous liquid nonionic surfactant detergent composition is formulated from the following ingredients in the amounts specified.

| | Weight % |
|---|---|
| Product D nonionic surfactant. | 30.0 |
| Acid terminated Dobanol 91-5 reaction product with succinic anhydride. | 5.0 |
| Sodium tri polyphosphate (TPP). | 30.0 |
| Diethylene glycol monobutylether anti-gel agent. | 10.0 |
| Amphoteric detergent(1). | 10.0 |
| Sodium perborate monohydrate bleaching agent. | 9.0 |
| Tetraacetylethylene diamine (TAED) bleach activator. | 4.5 |
| Stilbene brightener. | 0.5 |
| Protease (Esperase). | 1.0 |

(1)The amphoteric detergent used is

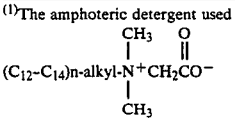

The addition of 10% of the amphoteric detergent is found to substantially increase the cleaning performance of the composition at elevated temperatures.

The formulation is ground for about 1 hour to reduce the particle size of the suspended builder salts to less than 10 microns. The formulated detergent composition is found to be stable and non-gelling in storage and to have substantially improved cleaning performance at high temperature.

EXAMPLE 2

A concentrated nonaqueous liquid nonionic surfactant detergent composition is formulated from the following ingredients in the amounts specified.

| | Weight % |
|---|---|
| Surfactant T7 | 17.2 |
| Surfactant T9 | 17.2 |
| Acid terminated Dobanol 91-5 reaction product with succinic anhydride. | 5.0 |
| Sodium tri-polyphosphate (TPP). | 30.0 |
| Diethylene glycol monobutylether anti-gel agent. | 10.0 |
| Amphoteric detergent(1). | 4.0 |
| Sodium perborate monohydrate bleaching agent. | 9.0 |
| Tetraacetylethylene diamine (TAED) bleaching agent. | 4.5 |
| Stilbene brightener. | 0.5 |
| Protease (Esperase). | 1.0 |
| Relatin DM 4096 (CMC/MC)(2).1.0 | 0.6 |
| Perfume. | |

(1)The amphoteric detergent is

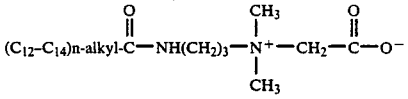

The addition of 4% of the amphoteric detergent is found to increase the cleaning performance of the composition at elevated temperatures.

The formulation is ground for about 1 hour to reduce the particle size of the suspended builder salts to less than 10 microns. The formulated detergent composition is found to be stable and non-gelling in storage and to have improved cleaning performance at high temperatures.

EXAMPLE 3

Concentrated nonaqueous liquid nonionic surfactant detergent compositions were formulated from the following ingredients in the amounts specified.

| | A (Comparison) | B (Invention) |
|---|---|---|
| Lutensol LF 400[1]. | 36.5 | 21.0 |
| Dowanol DB[1]. | 10.0 | 21.0 |
| Sodium tripolyphosphate (TPP). | 29.58 | 31.3 |
| Amphoteric detergent[3]. | — | 6.0 |
| HOE[4]. | 2.0 | — |
| Sodium perborate monohydrate. | 9.0 | 9.0 |
| TEAD[5]. | 4.5 | 4.5 |
| Relatin DM 4096 (CMC/MC)[6]. | 1.0 | 1.0 |
| Sokalan CP5[7]. | 4.0 | 2.0 |
| Dequest 2066[8] | 1.0 | 1.0 |
| Empiphos 5632[9]. | 0.3 | — |
| Urea[10]. | — | 1.0 |
| Esperase (protease enzyme). | 1.0 | 0.8 |
| Termamyl (amylolytic enzyme). | — | 0.2 |
| ATS-X (optical brightener). | 0.17 | 0.4 |
| Perfume. | 0.6 | 0.6 |
| $TiO_2$ (pigment). | 0.35 | 0.2 |
| | 100.00 | 100.00 |

[1]A nonionic surfactant detergent of the formula $$n\text{-}(C_{12}\text{-}C_{14})-(O-\underset{\underset{CH_3}{|}}{CH}-CH_2)_4-(OCH_2CH_2)_7-OH$$

[2]An anti-gelling agent of the formula $$n\text{-}C_4H_9-OCH_2CH_2-O-CH_2-CH_2OH.$$

[3]AMDML which is $$C_{12}H_{15}-\underset{\underset{CH_3}{|}}{\overset{\overset{CH_3}{|}}{N^+}}-CH_2-COO^-$$

[4]The HOE is

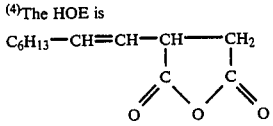

[5]Tetra-acetyl-ethylene diamine bleach activator.

[6]Anti-redeposition agent, a 2:1 mixture of sodium carboxymethyl cellulose and hydroxy methyl cellulose.

[7]Anti-encrustation agent - copolymer comprising about equal moles of methacrylic acid and maleic anhydride, neutralized to form the sodium salt thereof.

[8]Sequestering agent - diethylenetriamine pentamethylene phosphonic acid sodium salt (DTPMP).

[9]Anti-settling stabilizing agent - $C_{16}$ to $C_{18}$ alkanol partial ester of phosphoric acid.

[10]An anti-settling and stabilizing agent additive.

The formulations were ground for about 50 minutes in an Attritor mill to reduce the median size of the suspended builder salts to less than 5 microns.

A comparison of the cleaning performance of comparison composition A with the inventive composition B, containing the amphoteric detergent, at cleaning temperatures of 40° C., 60° C. and 90° C. gave the following results.

PERFORMANCE ON SPANGLER (DELTA RID)(1)

| | 40° C. (PE-C) | 60° C. (Cotton) | 90° C. (Cotton) |
|---|---|---|---|
| Comparison Formulation A | 27.5 | 17.3 | 14.3 |
| Inventive Formulation B | 28.7 | 22.0 | 25.5 |

(1) Standard detergency soiled swatches were washed in Ahiba launder-o-meter for thirty minutes at the referenced temperature. The detergent concentration was 5 gm/l (3 gm per 600 ml bowl). The Delta RD is the reflectance difference after and before the wash. Spangler soil contains oily, greasy and particulate soils, representative of real life. They are sensitive to detergency only. They are not sensitive to bleach or enzyme activity.

The data show that the addition of only six percent (6%) of the amphoteric detergent provided a slight increase in cleaning performance at 40° C.; a 27% increase at 60° C.; and a 78% increase at 90° C. as compared to the cleaning performance of comparison formulation A which contained no amphoteric detergent.

These improved results at elevated temperatures were obtained while maintaining the total detergent content of formulation (A) (Lutensol LF 400 36.5%+Dowanol DB 10%+HOE 2%=48.5%) about the same as that of formulation B (Lutensol LF 400 21%+Dowanol DB 21%+Amphoteric 6%=48%).

The formulations of Examples 1, 2 and 3 can be prepared without grinding the builder salts and suspended solid particles to a small particle size, but best results are obtained by grinding the formulation to reduce the particle size of the suspended solid particles.

The builder salts can be used as provided or the builder salts and suspended solid particles can be ground or partially ground prior to mixing them with the nonionic surfactant. The grinding can be carried out in part prior to mixing and grinding completed after mixing or the entire grinding operation can be carried out after mixing with the liquid surfactant. The formulations containing suspended builder and solid particles less than 10 microns in size are preferred.

It is understood that the foregoing detailed description is given merely by way of illustration and that variations may be made therein without departing from the spirit of the invention.

What I claim is:

1. A non-gelling concentrated fabric treating detergent composition which comprises a suspension of detergent builder salt particles in a nonaqueous nonionic liquid surfactant detergent and a sufficient amount of an amphoteric detergent to significantly increase the high temperature cleaning performance of the composition at temperatures above 60° C. which composition comprises at least one liquid nonionic surfactant in an amount of from about 10 to 70% by weight;

at least one detergent builder salt suspended in the nonionic surfactant in an amount of 10 to 60% by weight; and an amphoteric detergent in an amount of about 2 to 30% by weight.

2. The composition of claim 1 wherein the detergent builder salt is a phosphate detergent builder salt.

3. The composition of claim 1 wherein the detergent builder is an alkali metal salt of citric acid or tartaric acid.

4. The composition of claim 1 wherein the amphoteric surfactant is selected from the group consisting of (1) Betaine detergents having the formula $$R_1-\underset{\underset{R_3}{|}}{\overset{\overset{R_2}{|}}{N^+}}-R_4-\overset{\overset{O}{\|}}{C}O^-$$

(2) Alkyl bridged betaine detergents having the formula

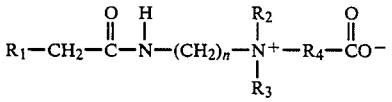

(3) Imidazoline detergents having the formula

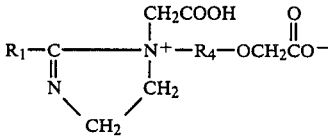

(4) Alkylimino propionate detergents having the formula

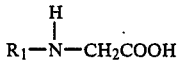

(5) Alkyliminodipropionate detergents having the formula

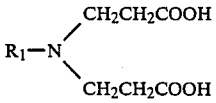

(6) Ether bridged alkyliminodipropionate detergents having the formula

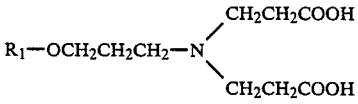

(7) Cocoimidzaoline based amphoteric detergents having the formula

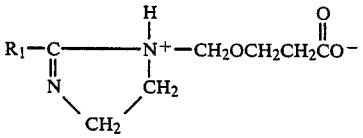

(8) Carboxyethylated higher fatty alkyl imidazoline based amphoteric detergents having the formula

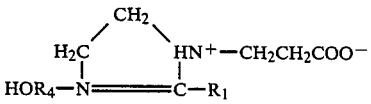

(9) Sulfo (amido) betaine

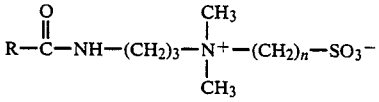

and mixtures thereof, wherein $R_1$ represents an aliphatic radical of from 7 to 20 carbon atoms, $R_2$ and $R_3$ each represent a lower alkyl group of 1 to 4 carbon atoms and $R_4$ represents a divalent lower alkyl radical of 1 to 4 carbon atoms.

5. The detergent composition of claim 1 wherein the composition comprises at least one viscosity control and anti-gel agent selected from the group consisting of an acid terminated nonionic surfacant and an alkylene glycol monoalkylether.

6. The detergent composition of claim 1 comprising one or more detergent adjuvants selected from the group consisting of anti-incrustation agent, alkali metal silicate, bleaching agent, bleach activator, sequestering agent, anti-redeposition agent, optical brightener, enzymes, perfume and dye.

7. The detergent composition of claim 1 comprising 15 to 50 percent of phosphate builder salt.

8. The detergent composition of claim 1 comprising 15 to 50 percent of an alkali metal salt of citric acid or tartaric acid builder.

9. The composition of claim 7 wherein the phosphate builder salts comprise an alkali metal polyphosphate.

10. The composition of claim 1 wherein the inorganic particles have a particle size distribution such that no more than about 10% by weight of said particles have a particle size of more than about 10 microns.

11. The detergent composition of claim 1 wherein the weight ratio of nonionic surfactant to amphoteric surfactant is 1:1 to 10:1.

12. A nonaqueous liquid heavy duty, built laundry detergent composition which has improved high temperature cleaning performance at temperatures above 60° C., and is pourable at high and low temperatures and does not gel when mixed with cold water, said composition comprising at least one liquid nonionic surfactant in an amount of from about 20 to about 60% by weight;

at least one detergent builder salt suspended in the nonionic surfactant in an amount of from about 15 to about 50% by weight; and a sufficient amount of an amphoteric detergent to increase the high temperature performance of the composition in an amount of about 2 to about 20% by weight.

13. The detergent composition of claim 12 which comprises at least one alkylene glycol monoalkylether viscosity control and gel inhibiting additive in an amount of about 5 to 30% by weight.

14. The detergent composition of claim 12 which comprises about 2 to 20 percent by weight of an acid terminated nonionic surfactant as a gel inhibiting additive.

15. The detergent composition of claim 12 wherein the weight ratio of nonionic surfactant to amphoteric surfactant is 1:1 to 8:1.

16. The detergent composition of claim 12 which optionally contains, one or more detergent adjuvants selected from the group consisting of enzymes, corrosion inhibitors, anti-foam agents, suds suppressors, soil suspending or anti redeposition agents, anti-yellowing agents, colorants, perfumes, optical brighteners, bluing agents, pH modifiers, pH buffers, bleaching agents, bleach stabilizers, bleach activators, enzyme inhibitors and sequestering agents.

17. A nonaqueous liquid heavy duty laundry detergent composition of claim 14 which comprises

| | Weight % |
|---|---|
| Nonionic surfactant in an amount of about | 25–50 |
| Amphoteric surfactant in an amount of about | 2–20 |
| Acid Terminated surfactant in an amount of about | 0–15 |
| Sodium Tri polyphosphate (TPP) in an amount of about | 15–50 |
| Alkylene glycol monoalkylether in an amount of about | 5–25 |
| Bleaching agent in an amount of about | 2–20 |
| Bleach activator in an amount of about | 1–8 |

18. A nonaqueous liquid heavy duty, built laundry detergent composition which has improved high temperature cleaning performance at temperatures above 60° C. which composition comprises

| | Weight % |
|---|---|
| Nonionic surfactant in an amount of about | 25–50 |
| Amphoteric surfactant in an amount of about | 4–15 |
| Sodium Tri polyphosphate (TPP) in an amount of about | 15–35 |

-continued

| | Weight % |
|---|---|
| Alkylene glycol monoalkylether in an amount of about | 15–25 |
| Sodium perborate monohydrate bleaching agent in an amount of about | 1–10 |
| Tetraacetylethylene diamine (TAED) bleach activator in an amount of about | 1–8 |

wherein the weight ratio of nonionic surfactant to amphoteric surfactant is about 2:1 to 6:1.

19. A method for cleaning soiled fabrics at elevated temperatures which comprises contacting the soiled fabrics in an aqueous washbath at wash temperatures above 60° C. with the laundry detergent composition of claim 1.

20. A method for cleaning soiled fabrics at elevated temperatures which comprises contacting the soiled fabrics in an aqueous washbath at wash temperatures above 60° C. with the laundry detergent composition of claim 15.

21. A method for cleaning soiled fabrics at elevated temperatures which comprises contacting the soiled fabrics in an aqueous washbath at wash temperature of above 60 to about 90° C. with the laundry detergent composition of claim 18.

* * * * *